US005658204A

United States Patent [19]

Nappi

[11] Patent Number: 5,658,204

[45] Date of Patent: Aug. 19, 1997

[54] PUTTING TRAINING DEVICE HAVING ADJUSTABLE STROKE

[76] Inventor: Jason S. Nappi, 2002 High St., Leesburg, Fla. 34748

[21] Appl. No.: 764,887

[22] Filed: Dec. 16, 1996

Related U.S. Application Data

[63] Continuation-in-part of Ser. No. 629,100, Apr. 8, 1996, abandoned.

[51] Int. Cl.[6] ..... A63B 69/36

[52] U.S. Cl. ..... 473/229; 473/230; 473/238; 473/258

[58] Field of Search ..... 473/229, 230, 473/238, 258

[56] References Cited

U.S. PATENT DOCUMENTS 2,706,635 4/1955 Thomas .
3,378,262 4/1968 Haley .
3,718,333 2/1973 Santoro et al. .
3,806,133 4/1974 Coleman .
3,963,244 6/1976 Mierzejewski .
4,133,535 1/1979 Marsh .
4,334,684 6/1982 Sterling .
4,634,131 1/1987 Vella et al. .
4,700,949 10/1987 Nottoli .
4,900,030 2/1990 Houtz .
4,919,433 4/1990 Millat .

*Primary Examiner*—George J. Marlo

[57] ABSTRACT

A golf stroke instruction device comprising an elongate, pivotally mounted club-engaging component whose range of motion can be selectively controlled by the user. This novel club-engaging component is operatively mounted adjacent at least one generally vertically disposed planar member. The planar member has an upper portion upon which the component is pivotally mounted for free swinging motion, with the planar member also having a face portion as well as a pair of side portions. A motion-limiting arrangement is utilized on each side portion of the planar member, serving to limit the motion of the club-engaging component as it moves along the face portion of the planar member and approaches a side portion. The motion-limiting arrangement I prefer to utilize involves a series of holes along each side portion of the planar member, into any one of which holes, a dowel or golf tee can be selectively inserted by a user of the device, whereby the range of permitted motion of the club-engaging component can be selectively controlled. In some instances I can mount the club-engaging component between a pair of generally planar members of substantially equal size supported in an upright position.

19 Claims, 7 Drawing Sheets

PUTTING TRAINING DEVICE HAVING ADJUSTABLE STROKE

RELATIONSHIP TO PREVIOUS INVENTION

This is a continuation-in-part application based upon my "The Perfect Putt," application Ser. No. 08/629,100, filed Apr. 8, 1996, now abandoned.

BACKGROUND OF THE INVENTION

In many respects, the correct use of the putter represents a more difficult problem for golfers than is presented by the other clubs. This is due to the reduced arc and non-vigorousness of the putting stroke. Also, it is necessary to strike the ball with the face of the putter precisely perpendicular to the intended path of the ball, and for maintaining this position of the putter during the entire putting stroke. Accuracy of stroking is more important with the putter than with any other club because of the small target at which the ball is directed, and the absolute requirement that unless the indicated relation of the club face and the ball is established, the ball will be irregularly struck and thereby not travel along the intended line.

Various prior art arrangements for training golfers in the use of putters have been proposed but these prior art proposals are characterized by their lack of differentiation between practicing and actual play. Also involved are the imprecise mechanisms which depend in their use, at least in part, upon the player-trainee's ability to keep the mechanism itself properly in position. This of course is counter-productive to the purpose of training a player to use his own standard putter in the most effective playing stroke.

The Thomas U.S. Pat. No. 2,706,635 entitled "Golf Stroke Instruction Device" relates to a tripod type device from which the handle portion of a putter is suspended. The configuration of the Thomas device is quite unwieldy and during use, involves the golfer having to straddle one of the legs of the device. The suspension arrangement for the golf club is such as to make it difficult for the player to grasp the handle in a comfortable manner.

The Haley U.S. Pat. No. 3,378,262 provides a single post guide which has at its bottom or foot portion a ground engaging part which is intended to fit within a complementary cavity in the bottom of a special putter. Thus, the training device is closely linked to a particular form of club; the two are available as a unit. While the club might be used alone, the intent of the patent is to use the guide and putter as a cooperating pair.

The Santoro et al U.S. Pat. No. 3,718,333 entitled "Golf Putter Guide" discloses a device which is linked to the lower shaft of a putter near its head, and while this may provide guidance to the head, it does not train the proper motion of the golfer's hands in the proper swinging of the club.

The Coleman U.S. Pat. No. 3,806,133 entitled "Golf Practicing Apparatus" is a bulky arrangement either requiring components to be inserted into the ground or else involving the use of "L" shaped brackets for the support of the device. This design involves relatively expensive components as well as a considerable amount of setup time.

The Mierzejewski U.S. Pat. No. 3,963,244 discloses a device which is intended to be permanently attached to the putter. While this may be useful as a special club, it in all likelihood is not a club which comes within the rules of the game, and this device cannot assist the player in training with a normal putter.

The Marsh U.S. Pat. No. 4,133,535 entitled "Putting Stroke Training Device" describes and shows an elaborate guide assembly, including spaced apart standards; rails extending between the standards; and a clamp for guiding the putter shaft, which includes a vertically disposed dovetail slide. The horizontal rails of the device must be aligned each time it is set up, to avoid binding of the guiding motion of the guiding carriage.

The Sterling U.S. Pat. No. 4,334,684 entitled "Golf Putting Training Device" is a four-legged affair involving members 22 and 24 slidable along elongate bars 18 and 20, respectively, which necessarily involves an expensive apparatus as well as one that is relatively time consuming to set up for use. In addition, the construction of the Sterling device is such as to require the golfer to assume an awkward stance.

The Vella et al U.S. Pat. No. 4,634,131 entitled "Golf Putting Trainer" is another of the devices of complex configuration necessitating expense as well as an inordinate amount of setup time. These patentees clamp a putter shaft between a pair of members representing a shaft guide slidable along a guide rail, with the club shaft constrained to move therewith. This is obviously a burdensome and expensive device requiring both setup time before use, as well as disassembly time after use.

The Nottoli U.S. Pat. No. 4,700,949 entitled "Golf Putting Trainer" involves a trolley provided with wheels to roll along a rail, with this arrangement also being expensive as well as requiring a considerable amount of setup time. The benefit to the golfer would not seem to be justified.

The Houtz U.S. Pat. No. 4,900,030 entitled "Putting Stroke Training Device" involves several generally tubular shaped components affixed together in a certain manner, but appearing to be expensive as well as difficult to use.

The Millat U.S. Pat. No. 4,919,433 entitled "Golf Putting Trainer" involves a putter training arrangement having the considerable disadvantage of the pivot point for the support components for the putter being at the bottom of the device rather than at the top of the device, thus being responsible for an unrealistic motion of the putter when being used as a training device.

As will be seen hereinafter, none of these prior art teachings is at all within the spirit of this invention.

SUMMARY OF THE INVENTION

A golf stroke instruction device in accordance with this invention comprises an elongate pivotally mounted club-engaging component whose range of motion can be selectively controlled. This club-engaging component is operatively mounted for limited swinging movement upon at least one planar member disposed in a generally vertically disposed manner. However, in a preferred embodiment, the club-engaging component is rotatably mounted in a relatively narrow space defined between front and rear generally vertically disposed planar members, in a manner permitting the club-engaging component to swing freely. The front and rear planar members are disposed in a parallel relationship and supported in a substantially vertical relationship to the ground.

The side edges of the planar members are disposed in substantial alignment, with motion-limiting means being provided on each side portion of each planar member. In a preferred embodiment, the motion-limiting means takes the form of a series of dowel-receiving holes disposed along each side edge of each of the members. The holes in one member are in substantial alignment with corresponding holes in the other member, such that a dowel or golf tee can be installed on one side edge of the front member and extend into the corresponding hole in the rear member. In this way the dowel serves, in a manner selected by the golfer as an effective means for limiting the motion of the club-engaging component as it approaches that side edge.

Dowels may be utilized on both side edges of the front and rear members, extending between corresponding holes located on both side edges, with these dowels limiting the motion of the club-engaging component in both directions.

Because a number of holes are disposed along the side edges of the planar members, the golfer can readily select the holes in which the dowels are placed, and therefore determine the extent of swinging-type motion of the club-engaging member that is possible.

The principal object of the present invention is to provide a putting instruction device in the nature of a mechanical aid which enables the user to develop the feel of the proper stroke during the back swing, impact and follow-through. The putter is mechanically guided by my novel elongate component during its movement so that the golfer may concentrate on other factors, such as the extent of the arc and the force at which the ball is to be propelled to the hole.

A further object of the present invention is to provide a training device which is constructed to permit the player to select by the use of easily positioned motion-limiting means, the length of putting stroke that is permitted in a given instance, which device may thereafter be readily modified to permit a putting stroke of different length.

A still further object of the present invention is to provide a training device whose use enables the player to develop a clear mental picture of the putting stroke, and which may be used with equal facility indoors or outdoors and by right-handed or left-handed players.

A yet still further object is to provide such a training device which is inexpensive to manufacture, which is easy to set up, easy to handle, and which can be employed with any putting stance and any type of putter.

The purpose and intent of a device in accordance with this invention is to heighten muscle memory; this being achieved by repeatedly practicing the correct putting stroke by use of the device, with or without a ball, and not only on the putting green, but also in the office and home.

These and other objects, features and advantages of this invention will shortly become evident.

DETAILED DESCRIPTION

Figure 1:
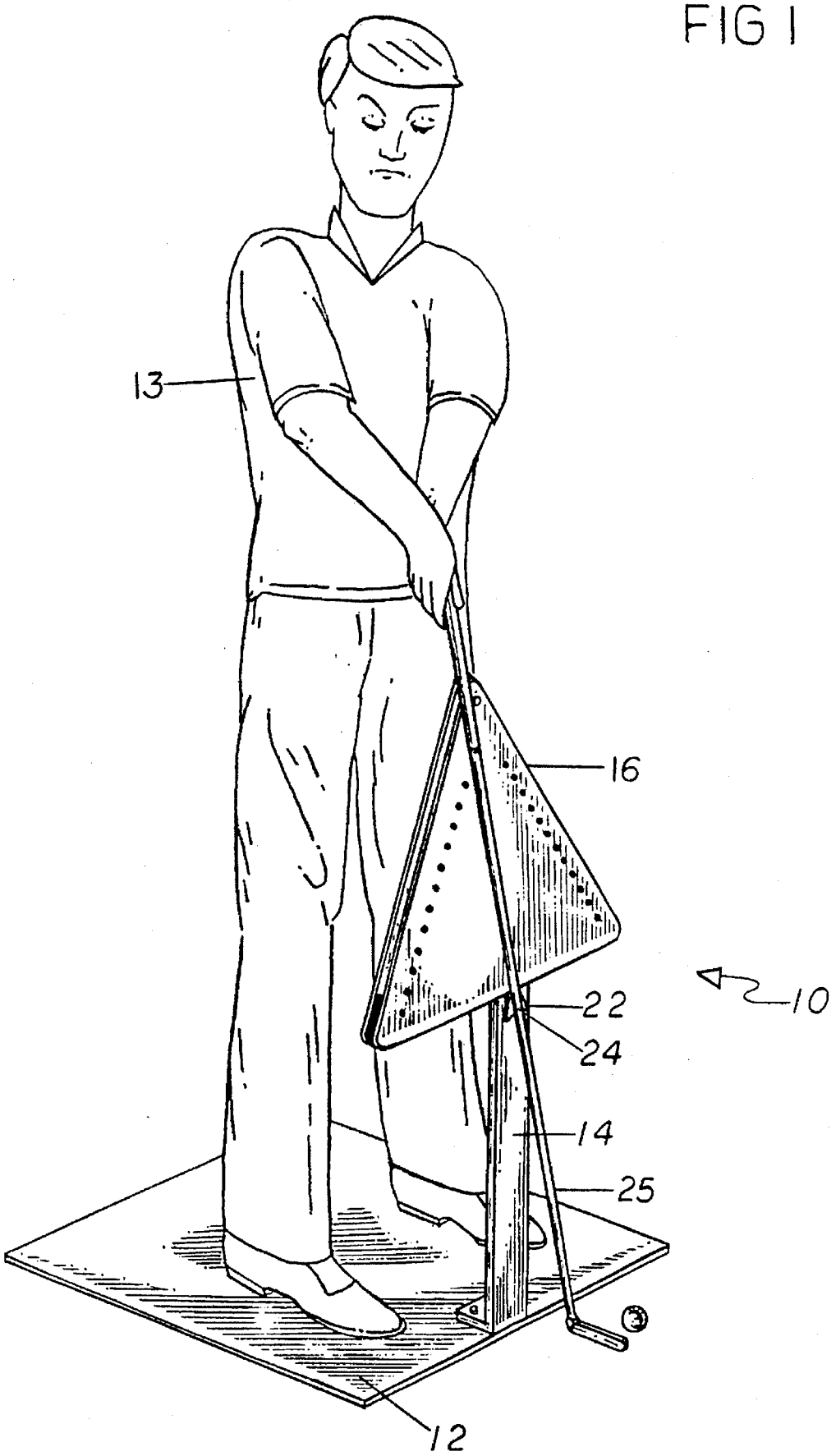
FIG. 1 is a perspective view of my novel putting training device in which a golfer is revealed to be holding the handle of a conventional putter, with this view also illustrating that a mid point of the shaft of the putter is engaged by a suitably shaped putter-engaging component, with latter component being rotatably supported from a generally vertically disposed planar member.

With initial reference to FIG. 1, it will be seen that I have shown an exemplary version of my golf stroke instruction device 10 readily usable for teaching golfers how to putt correctly. The device 10 comprises a base plate 12 upon which the golfer 13 may stand when using my device, with the base plate serving as a mounting means for a vertically disposed support member 14. The base plate I prefer to use offers a considerable amount of stability for my device, but the weight of the golfer standing on the plate 12 amounts to an arrangement providing even further stability and therefore considerable insurance against the device toppling over while it is in use.

Figure 2:
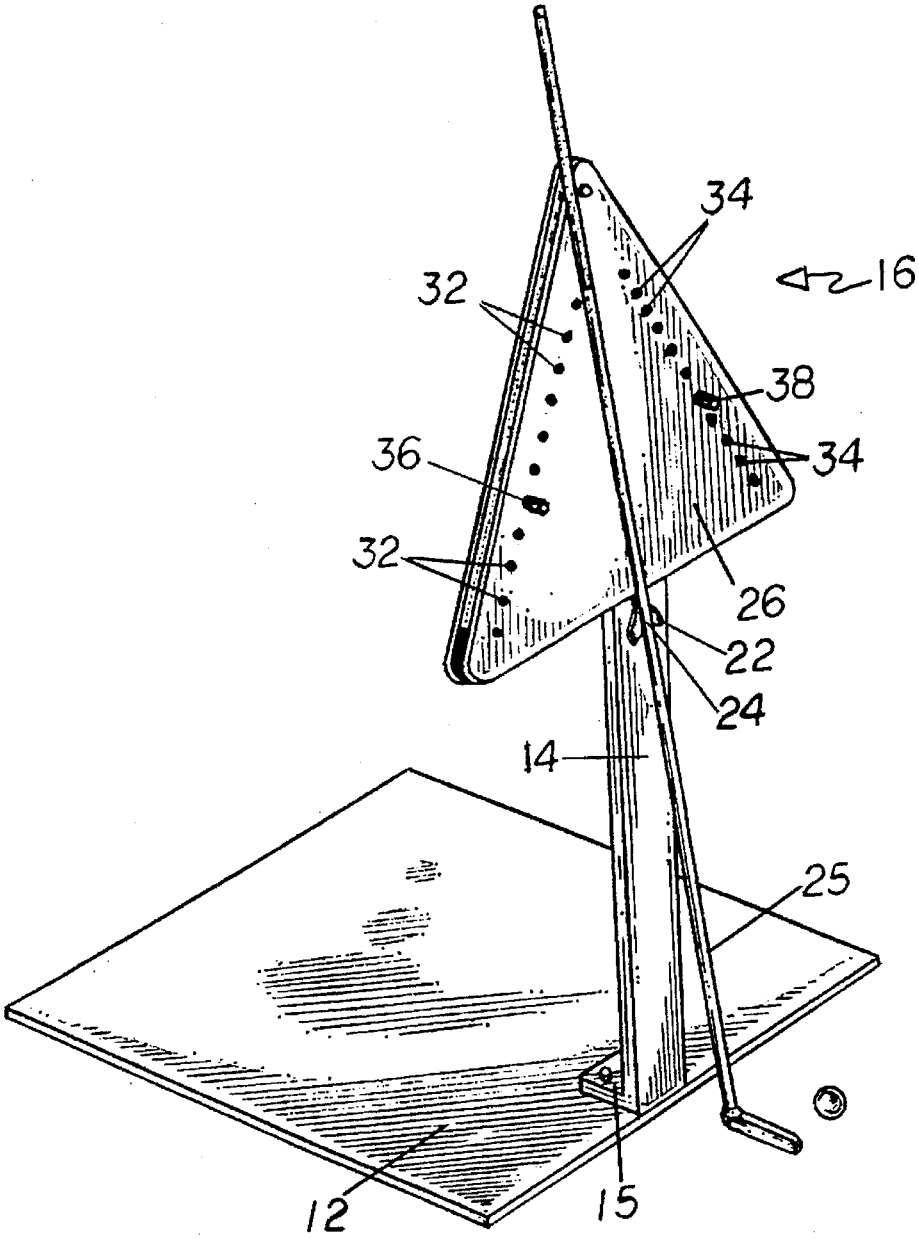
FIG. 2 is a perspective view to a slightly larger scale of the device of FIG. 1, with this figure revealing additional details of the invention, including the positioning of a pair of motion-limiting means in the form of a pair of dowels selectively inserted into holes located along the side edges of the generally vertically disposed planar member.

As viewed in FIG. 1 as well as in FIG. 2, the lower edge of the support member 14 is provided with a bent over portion 15, which contains holes through which bolts may pass. This arrangement makes it possible to securely bolt the support member 14 to the base member 12.

Figure 3:
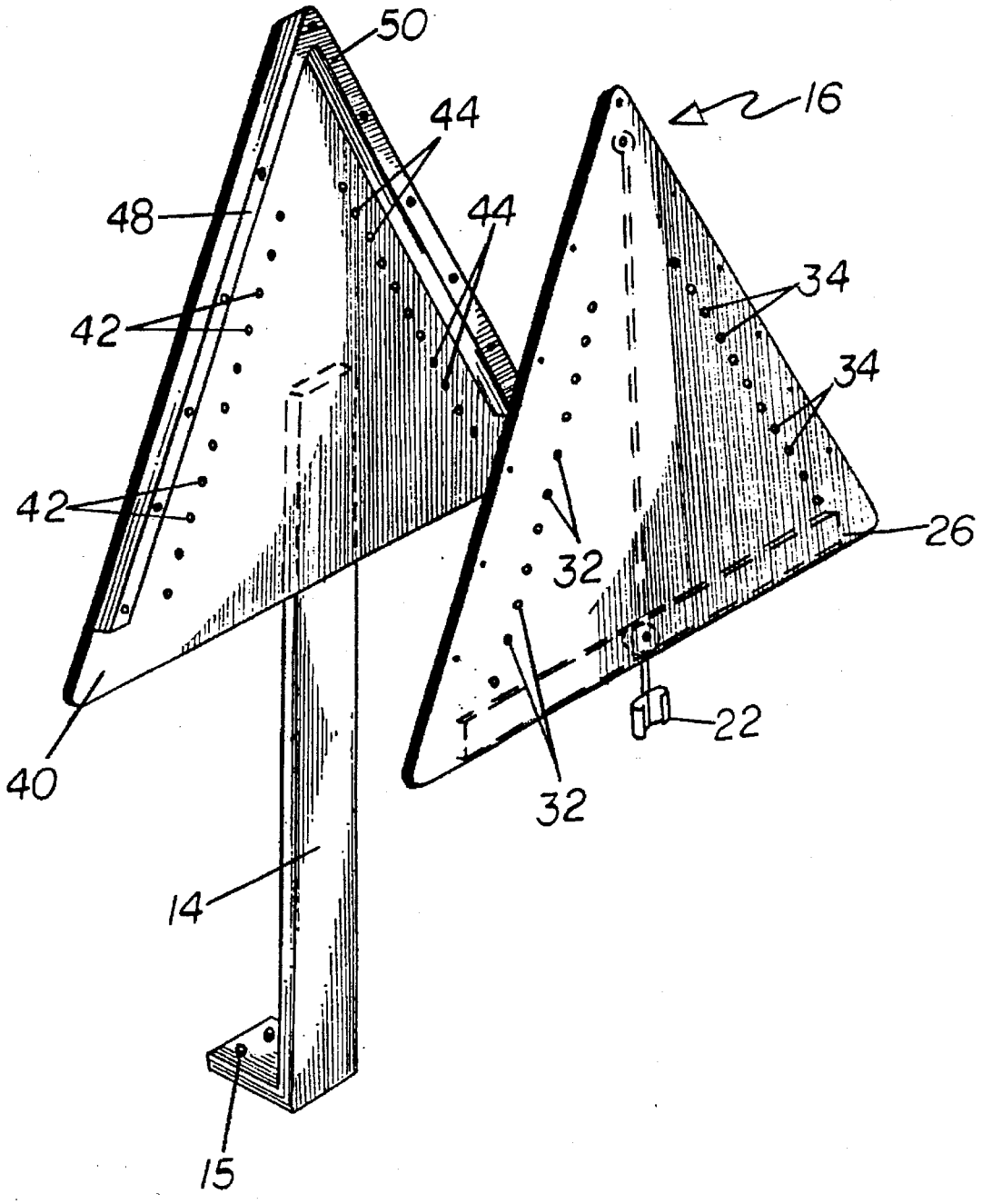
FIG. 3 is a perspective view showing the triangularly shaped front plate of the novel planar member of my device in an exploded relationship with respect to the back plate which may be used for supporting the front plate, with it to be understood that the dowel-receiving holes of the one plate are in alignment with the holes in the other plate.
Figure 4:
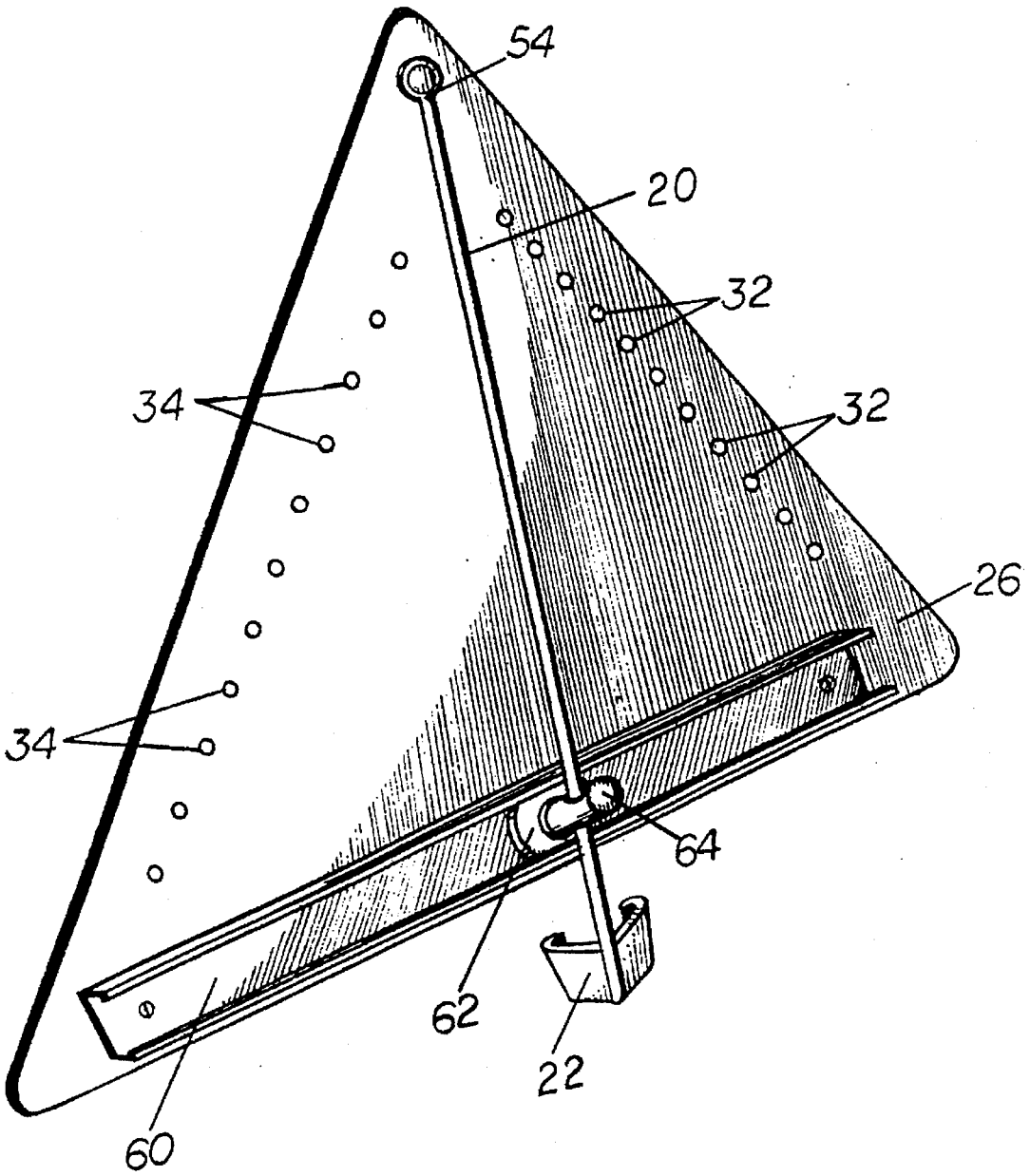
FIG. 4 is a view to a somewhat larger scale of the backside of my novel planar member or front plate, showing the preferred type of pivotal mounting for the putter-engaging component, such that this component can move across the face of the front plate between motion-limiting means in the form of dowel-receiving holes disposed on each side of the planar member, with this figure also revealing a track that may be utilized for use with a member to be attached to the club-engaging component.

Secured to the upper end of the support member 14, as revealed in FIGS. 1 and 2, is a triangularly shaped assembly 16 in which a club-engaging component 20 is pivotally mounted in a manner shown and described in conjunction with FIGS. 3 and 4, and certain other figures. As shown in FIGS. 1 and 2, but best seen in FIGS. 3 and 4, the lower end of the club-engaging component 20 is forked to form a clamping type device 22 able to be readily engaged by a mid portion 24 of the shaft 25 of the putter. In other words the clamping type device 22 represents a means for releasably grasping a mid portion of the shaft of the golf club.

With particular reference to FIG. 2, it will be seen that I have placed an aligned series of holes 32 down along portion of the portion of the front plate or planar member 26, and an aligned series of holes 34 down along the right side portion of the front plate or planar member. For a purpose described at length hereinafter, I have illustrated a dowel 36 installed in one of the holes 32 of the front plate, and a dowel 38 installed in one of the holes 34 of the front plate. I use the term dowel generically, and in some instances a user of my device may prefer to use golf tees instead of dowels in the holes 32 and 34.

With specific reference now to FIG. 3, it will be seen with regard to the triangularly shaped assembly 16 that a triangularly shaped back plate or planar member 40 is attached to the upper end of the vertically disposed support member 14. A spacer member 48 is secured along one upper edge or side portion of the back plate 40, whereas a spacer member 50 is secured along the other upper edge or side portion of the back plate.

With continued reference to FIG. 3, from this exploded view it can be seen that disposed in the back plate or planar member 40 are two sets of holes, with one set of holes 42 provided in a consistently spaced manner along a straight line paralleling the spacer member 48, and the other set of holes 44 provided in a consistently spaced manner along a straight line paralleling the spacer member 50. These two sets of holes are utilized for a purpose described hereinafter.

FIG. 3 reveals that the triangularly shaped front plate or planar member 26 is of a size consistent with the back plate 40 and its spacer members. With regard to the previously mentioned sets of holes 32 and 34 disposed in the front plate 26, the placement and spacing of holes 32 coincide with the placement and spacing of the set of holes 42 in the back plate, and the placement and spacing of holes 34 in the front plate coincide with the placement and spacing of the set of holes 44 in the back plate.

It is understood that the front plate 26 is screwed or otherwise secured to the spacer members 48 and 50 that are attached to the rear plate 40. By the front plate 26 being secured to the spacer members rather than directly to the back plate 40, space 52 of suitable dimension is defined between the front and back plates (see FIG. 5), in which space the putter-engaging component 20 is mounted for pivotal type motion along the near surfaces of the plates or planar members 26 and 40.

With reference to FIG. 4 it will be noted that this view represents the appearance of the backside of the front plate or planar member 26. It is important to note that the putter-engaging component 20 is pivotally supported at 54, which is a location relatively close to the apex or uppermost point of the front plate 26. The support for the component 20 is such that this component can normally swing freely across the face of the planar member 26, between the left and right edges of this member, with the space made possible by the utilization of spacers 48 and 50 on the back plate 40 making it possible for the component 20 not to have any undesirable frictional contact with either of these planar members.

To provide a uniformity and consistency of swinging motion of the component 20, I may optionally provide a track member 60 that, as depicted in FIG. 4, is secured along the bottom interior edge of the face of the front plate 26. The track member 60 is of U-shaped cross-section so as to receive therein, a generally circularly-shaped member 62, which is small enough not to have any sizable amount of frictional contact with the upper and lower flanges of the track 60. On the other hand, the slidable member 62 is large enough not to become dislodged from the upper and lower flanges of the track as the component 20 is caused to swing back and forth about its pivotal support 54. It is to be noted that the component 20 is attached to the member 62 by the use of a loosely fitting clip or clamp 64. This arrangement is utilized so that relative motion between the component 20 and the clip or clamp 64 can take place in the longitudinal direction during the swinging motion of the component 20 across the face of the planar member 26, as a consequence of its pivotal mounting upon its support point 54.

One of the important aspects of this invention involves the fact that highly effective yet simple motion-limiting means are provided for controlling the extent of arcuate motion that the golfer can cause the component 20 to make across the face of the planar member 26. It was mentioned in connection with FIG. 2 that I provide dowels 36 and 38 in selected locations in the holes 32 and 34, respectively, of the front plate 26, with these dowels effectively serving as motion-limiting means. It was set forth in connection with FIG. 3 that the placement and spacing of holes 32 in the front plate coincide with the placement and spacing of the set of holes 42 in the back plate, and the placement and spacing of holes 34 in the front plate coincide with the placement and spacing of the set of holes 44 in the back plate. This arrangement makes it possible for one or more dowels or golf tees to be inserted through an aligned pair of holes so as to serve as the means for limiting the distance that the component 20 is permitted to swing.

A golf tee or dowel inserted into a selected front hole 32 in the front plate also moves into the hole in the back plate disposed in alignment with the selected hole in the front plate. Likewise a golf tee or dowel inserted into a selected hole 34 in the front plate also moves into the hole in the back plate disposed in alignment with this selected hole.

With particular reference to FIG. 4, it is to be noted that the pivotal support 54 for the member 20 is located at least an inch above the location where upward extensions of the straight lines upon which the holes 32 and 34 are located would intersect. This is because if the pivot point 54 were located directly on the extension of the lines upon which these holes are disposed, no range of motion of the club-engaging component 20 could be selected by the user.

A typical instance would involve the golfer inserting, as viewed in FIG. 2, a dowel or golf tee in a selected hole 32 on the left side of the front plate 26, and a dowel or golf tee in a selected hole 34 on the right side of the front plate, with a portion of these dowels protruding out onto the outer surface. In each instance the golf tee or dowel also extends into the corresponding hole in the back plate, as explained hereinabove.

From reference to FIG. 4, showing the rear side of the front plate 26, it can be appreciated if a dowel or golf tee is installed in one of the upper holes of the array of holes 32 or 34, these dowels or golf tees will serve as motion-limiting means that rather severely limit the permissible swinging motion of the club-engaging component 20. On the other hand, if a dowel or golf tee is inserted in one of the lower holes of set of holes 32 or 34, that is, the holes further from the support point 54 and closer to the track member 60, this will permit a wide range of swinging motion of the component 20.

As is obvious, for an intermediate amount of motion to be permitted, a dowel or golf tee is installed in one of the holes in the middle of the hole array 32, and another dowel or golf tee is installed in the middle of the hole array 34. It is important to note that there is no requirement that the dowel or golf tee installed in one of the holes 32 must be the same distance away from the track member 60 as the dowel or golf tee installed in one of holes 34.

The consequence of the placement of the dowels 36 and 38 in selected holes 32 and 34 of the front plate is best illustrated by reference to related FIGS. 6*a* through 6*c*, wherein I have shown the aligned set of holes 32 disposed along the left edge of the front plate 26 and the aligned set of holes 34 disposed along the right edge of the front plate.

Figure 6A:
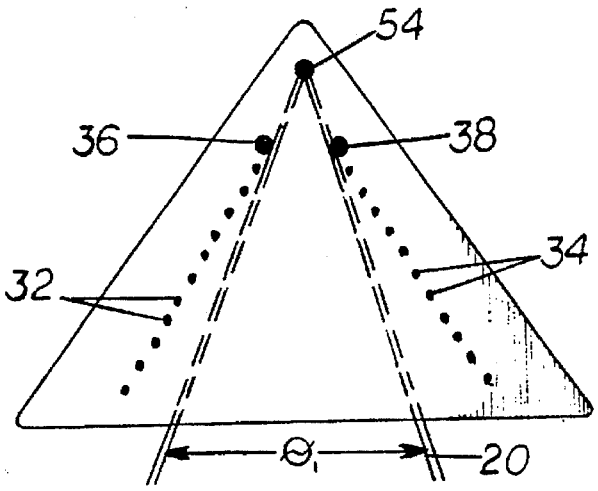
FIG. 6*a* is a view of my device in which the motion-limiting dowels have been placed so as to permit only a minimum swing path or arc of travel for the putter-engaging component.

In FIG. 6*a*, I have shown the dowels 36 and 38 disposed at the upper end of the sets of holes 32 and 34, meaning that they are relatively near to the pivotal support 54. Although the club-engaging component 20 is pivotally mounted on the backside of front plate 26 and therefore has been depicted in dashed lines in part of this figure, it nevertheless is apparent that the range of motion of the component 20 across the face of the front planar member in this instance is comparatively limited. The permissible movement of the club-engaging component 20 is represented by a relatively small angle $\theta_1$.

Figure 6B:
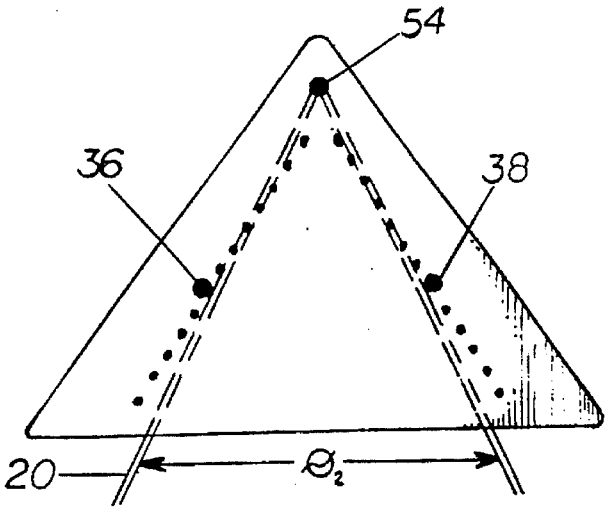
FIG. 6*b* is a view of my device in which the motion-limiting dowels have been placed in an intermediate position so as to permit an average amount of arc of travel for the putter-engaging component.

Turning to FIG. 6*b*, it will be noted that I have here moved the dowels 36 and 38 further down the aligned series of holes 32 and 34, meaning that the dowels are now further away from the pivotal support 54. As is apparent from the extreme positions indicated for the component 20, the component can be moved over a greater angle than was previously possible, with this greater angle being designated as $\theta_2$.

Figure 6C:
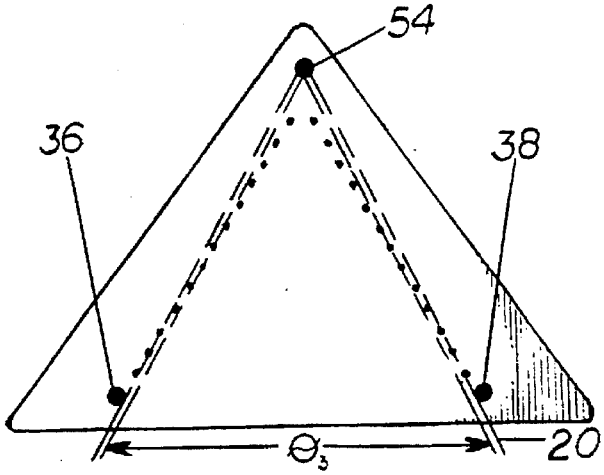
FIG. 6*c* is a view of my device in which the motion-limiting dowels have been placed in the extreme downward position, so as to permit a maximum swing path or arc of travel for the putter-engaging component.
Figure 7A:
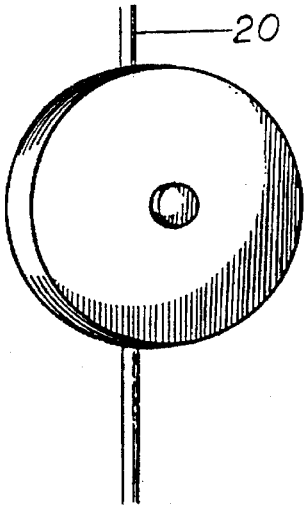
FIG. 7*a* is a view of one type of mounting arrangement utilized for a member slidably attached to the putter-engaging component and movable along the optionally utilized track depicted in FIG. 4.
Figure 7B:
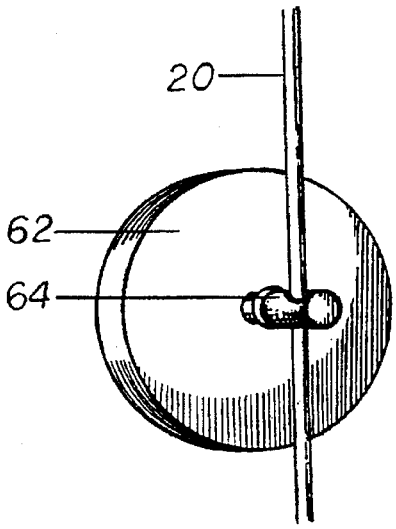
FIG. 7*b* is a view similar to FIG. 7*a* but here revealing other details of the manner in which the sliding attachment may be made between the member and the putter-engaging component.
Figure 7C:
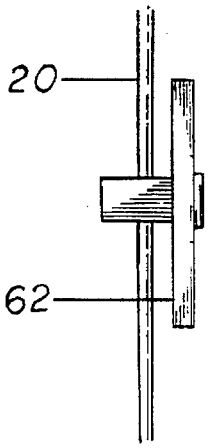
FIG. 7*c* is a side elevational view of the arrangement shown in FIG. 7*b*, with it to be understood that the member utilized in the track is constructed to permit longitudinal movement of the club-engaging component as the club-engaging component swings back and forth across the face of the planar member.

With reference now to FIG. 6*c*, in this instance I have moved the dowels 36 and 38 even further down the aligned series of holes, such that the dowels are now even further away from the pivotal support 54. This of course means that the extreme positions for the component 20 are even more divergent than was previously the case, with the angle representative of the wide possible swings of the component 20 being represented by angle $\theta_3$.

It is thus to be seen that provided in accordance with this invention is a putting instruction device in the nature of a relatively inexpensive mechanical aid which enables the user to develop the feel of the proper stroke during the back swing, impact and follow-through. The putter is mechanically guided by this novel elongate component 20 during its movement so that the player may concentrate on other factors, such as the extent of the arc and the force at which the ball is to be propelled to the hole.

Figure 5:
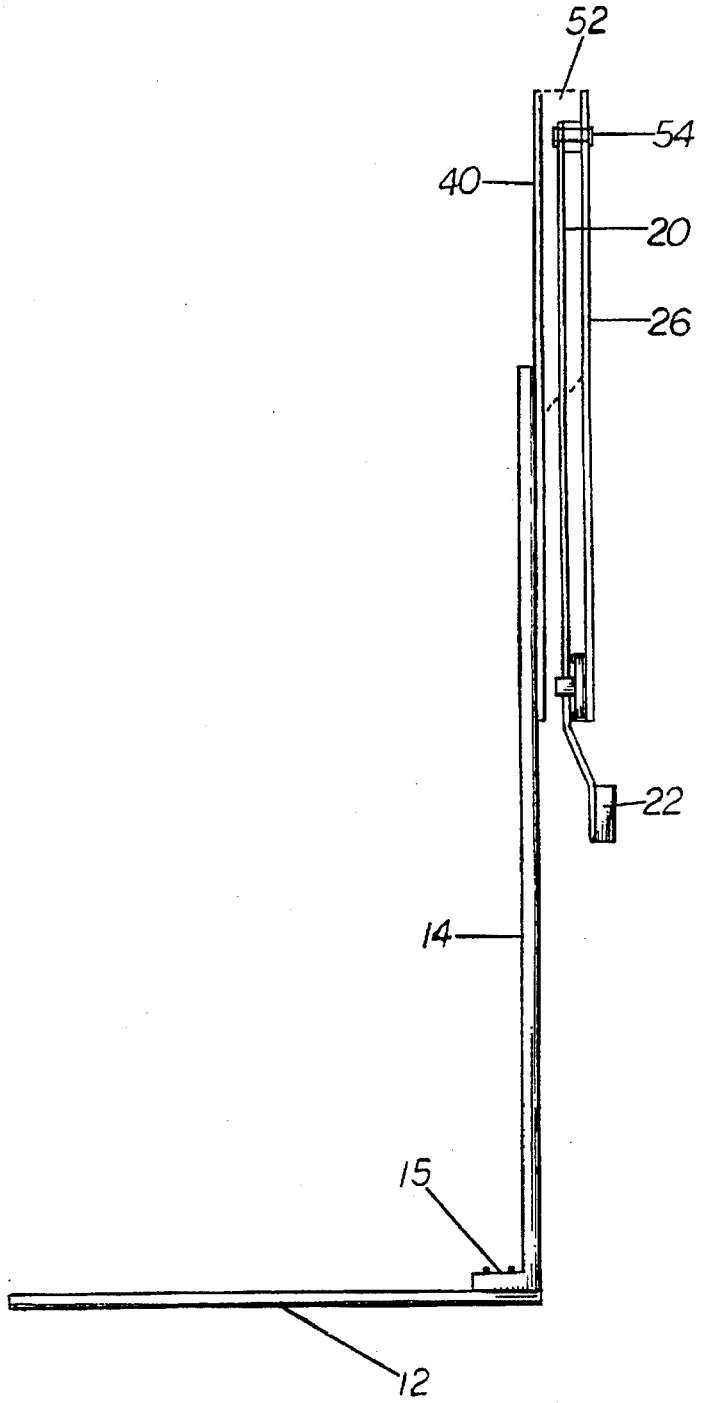
FIG. 5 is a side elevational view revealing the front plate in a spaced relationship to the back plate, with this view further illustrating that the putter-engaging component is mounted on the backside of the front plate and freely movable in the space provided between the plates.

Although the construction set forth in locations such as FIGS. 3 and 5 illustrate the use of a spaced pair of plates 26 and 40, it is not required that a pair of planar members be utilized in carrying out the novel concepts of my invention. With reference to FIG. 4 for example, it is readily apparent that the planar member 26 could be supported from its lower corners, at locations near the ends of track 60. This arrangement would not interfere with the motion of either the club-engaging component 20 across the face of the plate 26, nor would it interfere with motion of the club handle across the opposite face of the member 26.

If only a single planar member rather than a pair of planar members are utilized, it is obvious that the dowels or golf tees must be long enough to protrude sufficiently far away from the face of the planar member as to serve appropriate motion-limiting roles.

As should now be apparent, my novel device enables the player to develop a clear mental picture of the putting stroke, which may be used with equal facility indoors or outdoors and by right-handed or left-handed players.

I claim:

1. A golf stroke instruction device comprising an elongate, pivotally mounted club-engaging component whose range of motion can be selectively controlled, said club-engaging component being operatively mounted adjacent at least one generally vertically disposed planar member, said planar member having an upper portion upon which said component is pivotally mounted for free swinging motion, said planar member also having a face portion as well as a pair of side portions, motion-limiting means disposed on each side portion of said planar member, serving to limit the motion of said club-engaging component as it moves along the face portion of said planar member and approaches such a side portion, said motion-limiting means being readily positionable by a user of said device, whereby the range of permitted motion of said club-engaging component can be selectively controlled.

2. The golf stroke instruction device comprising an elongate, pivotally mounted club-engaging component as recited in claim 1 in which a lower portion of said club-engaging component has means for releasably grasping a mid portion of the shaft of a golf club.

3. The golf stroke instruction device comprising an elongate, pivotally mounted club-engaging component as recited in claim 1 in which said motion-limiting means involve a plurality of holes utilized on each side portion of said generally planar member, with each of said holes being able to receive a dowel serving to limit the motion of said club-engaging component across said face portion.

4. The golf stroke instruction device comprising an elongate, pivotally mounted club-engaging component as recited in claim 1 in which said motion-limiting means involve a series of aligned holes utilized along each side portion of said member, with each of said holes being able to receive a dowel serving to limit the swinging motion of said club-engaging component across said face portion.

5. The golf stroke instruction device comprising an elongate, pivotally mounted club-engaging component as recited in claim 1 in which said planar member is generally triangularly shaped, with said club-engaging component being supported from a location adjacent the uppermost portion of said triangularly shaped member, and a series of aligned holes utilized down along each of said side portions of said member, with each of said holes being able to receive a dowel serving as a means for limiting the swinging motion of said club-engaging component.

6. The golf stroke instruction device comprising an elongate, pivotally mounted club-engaging component as recited in claim 5 in which the range of permitted swinging motion of said club-engaging component can be increased by installing the dowels further from said support location for said club-engaging component.

7. A golf stroke instruction device comprising an elongate, pivotally mounted club-engaging component whose range of motion can be selectively controlled, said component being operatively mounted adjacent at least one generally vertically disposed planar member, said planar member having an upper portion upon which said component is pivotally mounting for free swinging motion, said planar member also having a face portion as well as a pair of side portions, a plurality of dowel-receiving holes disposed along each side portion of said planar member, a dowel installed on one side portion of said member and protruding from said face portion for a sufficient extent as to limit the motion of said club-engaging component as it moves across said face portion of said planar member and approaches that side portion.

8. The golf stroke instruction device comprising an elongate, pivotally mounted club-engaging component as recited in claim 7 in which said planar member is generally triangularly shaped, with a series of aligned holes utilized along each of said side portions of said member, with each of said holes being able to receive a dowel serving to limit the motion of said club-engaging component as it swings across the face of said component.

9. The golf stroke instruction device comprising an elongate, pivotally mounted club-engaging component as recited in claim 8 in which the range of permitted swinging motion of said club-engaging component can be increased by installing the dowels further from said support location for said club-engaging component.

10. A golf stroke instruction device comprising an elongate, pivotally mounted club-engaging component whose range of motion can be selectively controlled, said component being operatively mounted between a pair of generally planar members disposed in a closely spaced, substantially parallel relationship, with the side edges of said members being in substantial alignment, means for supporting said club-engaging component in a free-swinging manner between said pair of members, a series of dowel-receiving holes disposed along the side edges of each of said members, with the holes in one member being in substantial alignment with the holes in the other member, thus to permit a given dowel to extend between both members, a dowel installed on one side edge of said members so as to extend between corresponding holes in said pair of members serving to limit the swinging motion of said club-engaging component as it approaches that side edge.

11. The golf stroke instruction device comprising a pivotally mounted club-engaging component as recited in claim 10 in which a lower portion of said club-engaging component has means for releasably grasping a mid portion of the shaft of a golf club.

12. The golf stroke instruction device comprising a pivotally mounted club-engaging component as recited in claim 10 in which dowels are utilized on both side edges of said members, in each instance extending between corresponding holes located in each member, with the dowels limiting the swinging motion of said club-engaging component in both directions of travel.

13. The golf stroke instruction device comprising a pivotally mounted club-engaging component as recited in claim 12 in which the range of permitted swinging motion of said club-engaging component can be increased by installing the dowels further from said support means for said club-engaging component.

14. The golf stroke instruction device comprising an elongate, pivotally mounted club-engaging component as recited in claim 10 in which said planar members are generally triangularly shaped.

15. A golf stroke instruction device comprising a pivotally mounted club-engaging component whose range of motion can be selectively controlled, said component being operatively mounted in a relatively narrow space defined between front and rear generally planar members disposed in an essentially parallel relationship, means for supporting said front and rear generally planar members in a substantially vertical relationship to the ground, with the side edges of said members being in substantial alignment, said club-engaging component being mounted in a free swinging manner between said front and rear members, with a series of dowel-receiving holes disposed along each side edge of each of said members, with the holes in one member being in substantial alignment with corresponding holes in the other member, a dowel installed on one side edge of said members, so as to extend between corresponding holes in both members serving to limit the swinging motion of said club-engaging component as it approaches that side edge.

16. The golf stroke instruction device comprising a pivotally mounted club-engaging component as recited in claim 15 in which a lower portion of said club-engaging component has means for releasably grasping a mid portion of the shaft of a golf club.

17. The golf stroke instruction device comprising a pivotally mounted club-engaging component as recited in claim 15 in which a dowel is utilized on both side edges of said front and rear members, extending between corresponding holes located on both side edges, with the dowels limiting the swinging motion of said club-engaging component in both directions.

18. The golf stroke instruction device comprising an elongate, pivotally mounted club-engaging component as recited in claim 15 in which said planar members are generally triangularly shaped.

19. The golf stroke instruction device comprising a pivotally mounted club-engaging component as recited in claim 15 in which the range of permitted swinging motion of said club-engaging component can be increased by installing the dowels further from said mounting for said club-engaging component.

* * * * *